US007048700B1

(12) United States Patent
Gustie

(10) Patent No.: US 7,048,700 B1
(45) Date of Patent: May 23, 2006

(54) HEAD SUPPORT DEVICE

(76) Inventor: Gregory M. Gustie, 514 E. Behrend Dr., Phoenix, AZ (US) 85024

( * ) Notice: Subject to any disclaimer, the term of this patent is extended or adjusted under 35 U.S.C. 154(b) by 579 days.

(21) Appl. No.: 10/327,985

(22) Filed: Dec. 26, 2002

(51) Int. Cl.
*A61H 1/00* (2006.01)

(52) U.S. Cl. ..... 601/5; 601/39; 606/237; 128/845

(58) Field of Classification Search ..... 601/5, 601/23–26, 29, 39, 84, 97, 98, 101; 602/32, 602/33; 606/204.15, 237, 240–242; 482/10, 482/907; 128/846, 857, 869, 870, 876, 882; 294/19.1, 74, 99.1, 99.2; 211/119.1; 5/622
See application file for complete search history.

(56) References Cited

U.S. PATENT DOCUMENTS

| | | | | |
|---|---|---|---|---|
| 133,530 | A * | 12/1872 | Hadden | 211/119.1 |
| 450,188 | A * | 4/1891 | Peterson | 482/10 |
| 3,258,790 | A | 7/1966 | Maru | |
| 3,960,145 | A * | 6/1976 | Scarbrough | 602/2 |
| 5,137,015 | A * | 8/1992 | Anglehart | 601/98 |
| 5,242,347 | A * | 9/1993 | Keeton | 482/102 |
| 5,709,649 | A | 1/1998 | Chitwood | |
| 5,993,357 | A | 11/1999 | Tom et al. | |
| 6,221,036 | B1 | 4/2001 | Lucas | |
| 6,511,450 | B1 * | 1/2003 | Bauermeister | 602/33 |
| 6,702,768 | B1 * | 3/2004 | Mano et al. | 601/29 |

* cited by examiner

*Primary Examiner*—Danton Demille
*Assistant Examiner*—Manuj Agarwal

(57) ABSTRACT

A head support device includes a base including a horizontal portion and a pair of vertical members that are attached to and extend upwardly from the horizontal portion so that a first vertical member and a second vertical member are defined. A strap has a first end and a second end. The second end of the strap is attached to the second vertical member. A retracting mechanism draws the strap toward or releases the strap away from the first vertical member. The retracting mechanism is attached to the first vertical member. A portion of the strap positioned between the vertical members is moved upwardly away from the horizontal portion when the strap is drawn toward the first vertical member and is moved toward the horizontal portion when the strap is released away from the first vertical member.

6 Claims, 5 Drawing Sheets

HEAD SUPPORT DEVICE

BACKGROUND OF THE INVENTION

1. Field of the Invention

The present invention relates to headrest devices and more particularly pertains to a new headrest device for providing a user with a therapeutic device that would enable the individual to engage in relaxation therapy in their home for the treatment of neck and shoulder pressure and pain.

2. Description of the Prior Art

The use of headrest devices is known in the prior art. U.S. Pat. No. 5,993,357 describes a neck exercise apparatus for developing strength, endurance, and flexibility of the neck. Another type of headrest device is U.S. Pat. No. 6,221,036 describes a support for a limb of the body having a sheet of flexible material secured to rods at each end. U.S. Pat. No. 3,258,790 describes a pillow which would allow air to circulate between the user's head and his bed when in use. U.S. Pat. No. 5,709,649 describes a neck curvature alignment device comprising a framework including a base portion adapted to be supported on a planar surface. The device includes a moving mechanism that engages and bears against the users head.

While these devices fulfill their respective, particular objectives and requirements, the need remains for a device that includes a pair of vertical support arms that support a strap for supporting the head of a user. The support arms also include an adjustment system for raising and lowering a users head upon activating the actuator.

SUMMARY OF THE INVENTION

The object of the present invention is to provide a new headrest device that would be portable and easy to setup within the home, requiring very little space when used on any flat surface.

Another object of the present invention is to provide a new headrest device that would reduce the cost of daily physical therapy and chiropractic treatments provided in a facility or with input from a physical therapist.

To this end, the present invention generally comprises a base including a horizontal portion and a pair of vertical members that are attached to and extend upwardly from the horizontal portion so that a first vertical member and a second vertical member are defined. A strap has a first end and a second end. The second end of the strap is attached to the second vertical member. A retracting mechanism draws the strap toward or releases the strap away from the first vertical member. The retracting mechanism is attached to the first vertical member. A portion of the strap positioned between the vertical members is moved upwardly away from the horizontal portion when the strap is drawn toward the first vertical member and is moved toward the horizontal portion when the strap is released away from the first vertical member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty, which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
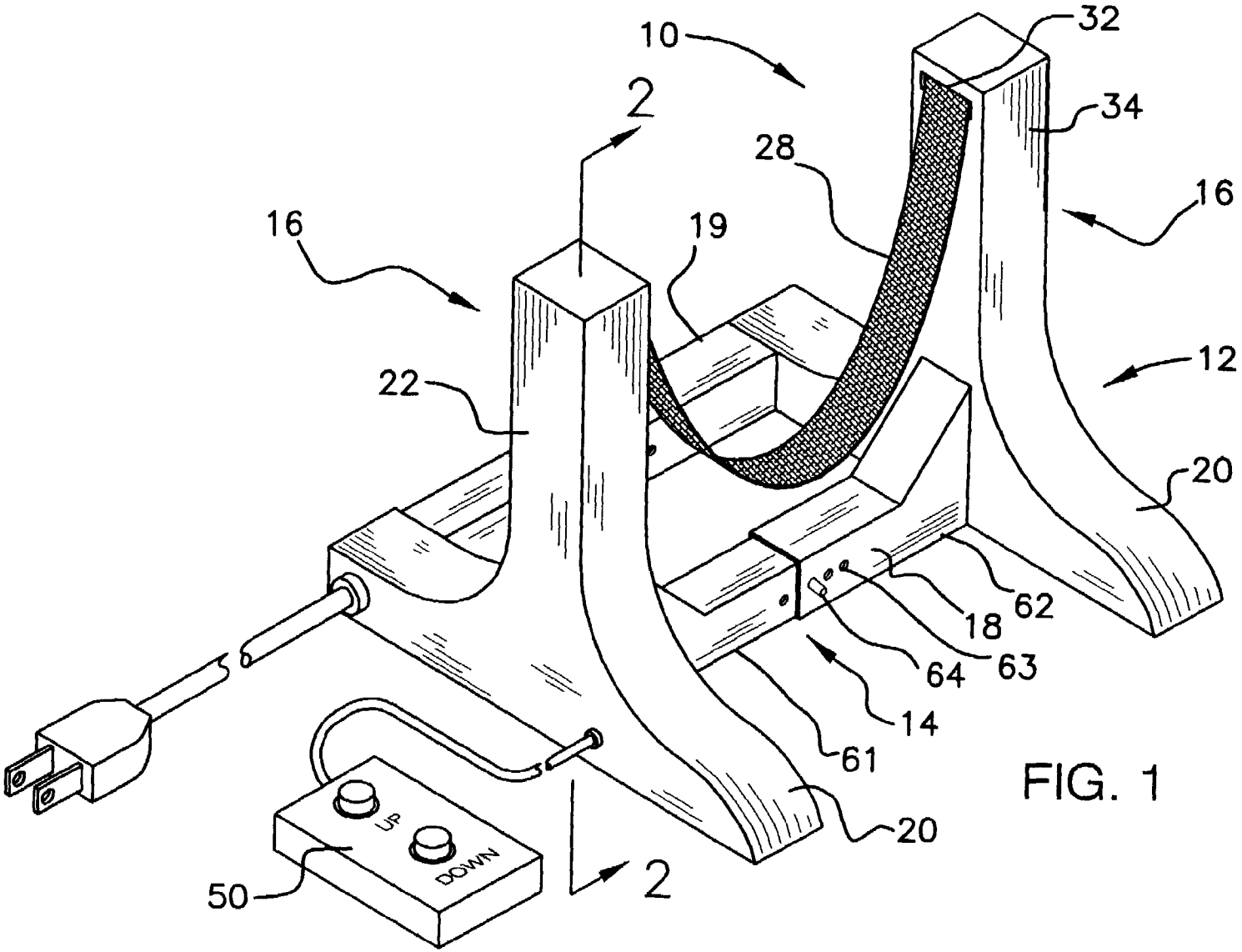
FIG. 1 is a perspective view of a head support device according to the present invention.
Figure 2:
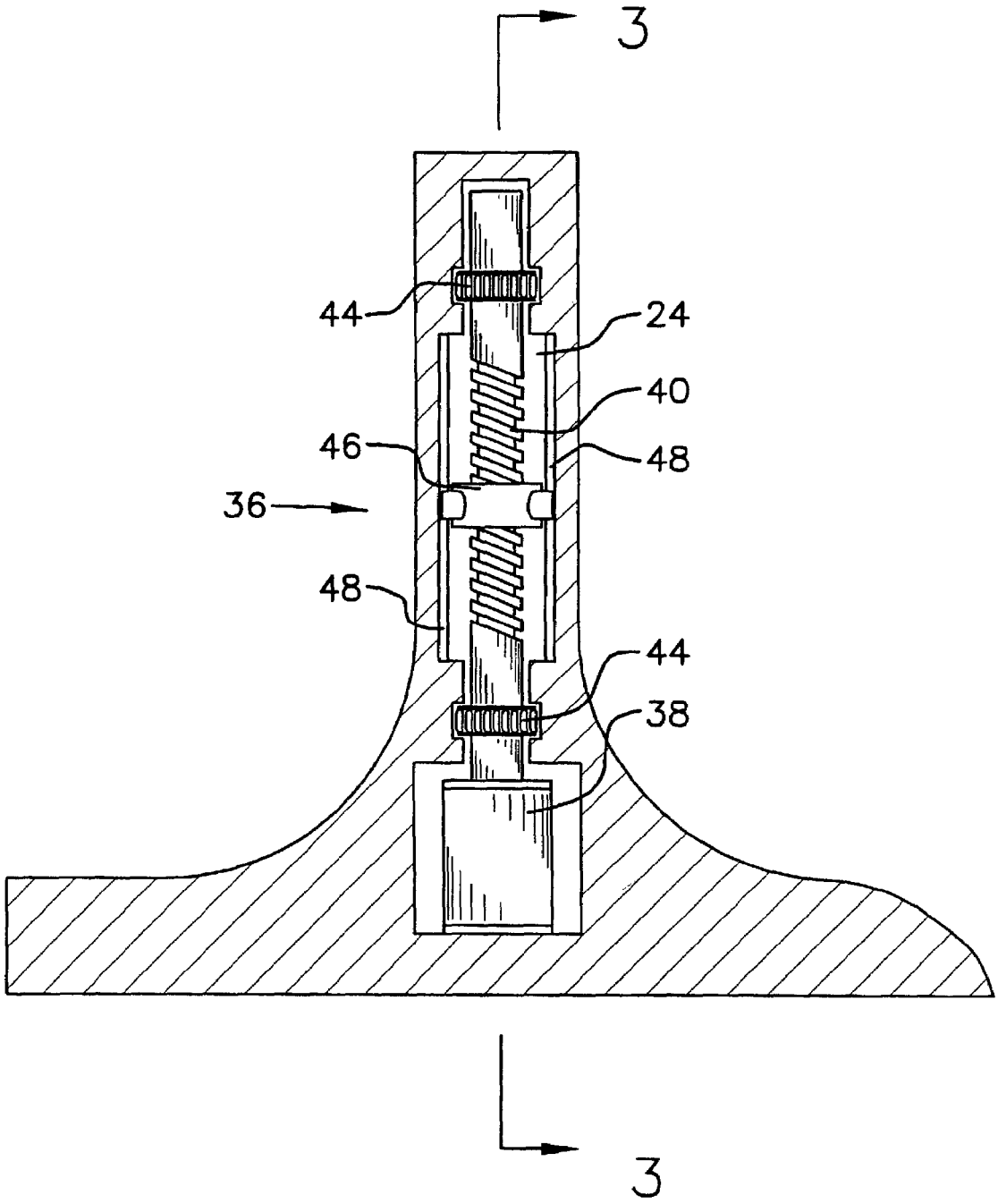
FIG. 2 is a cross-sectional view taken along the line 2—2 of FIG. 1 of the present invention.
Figure 3:
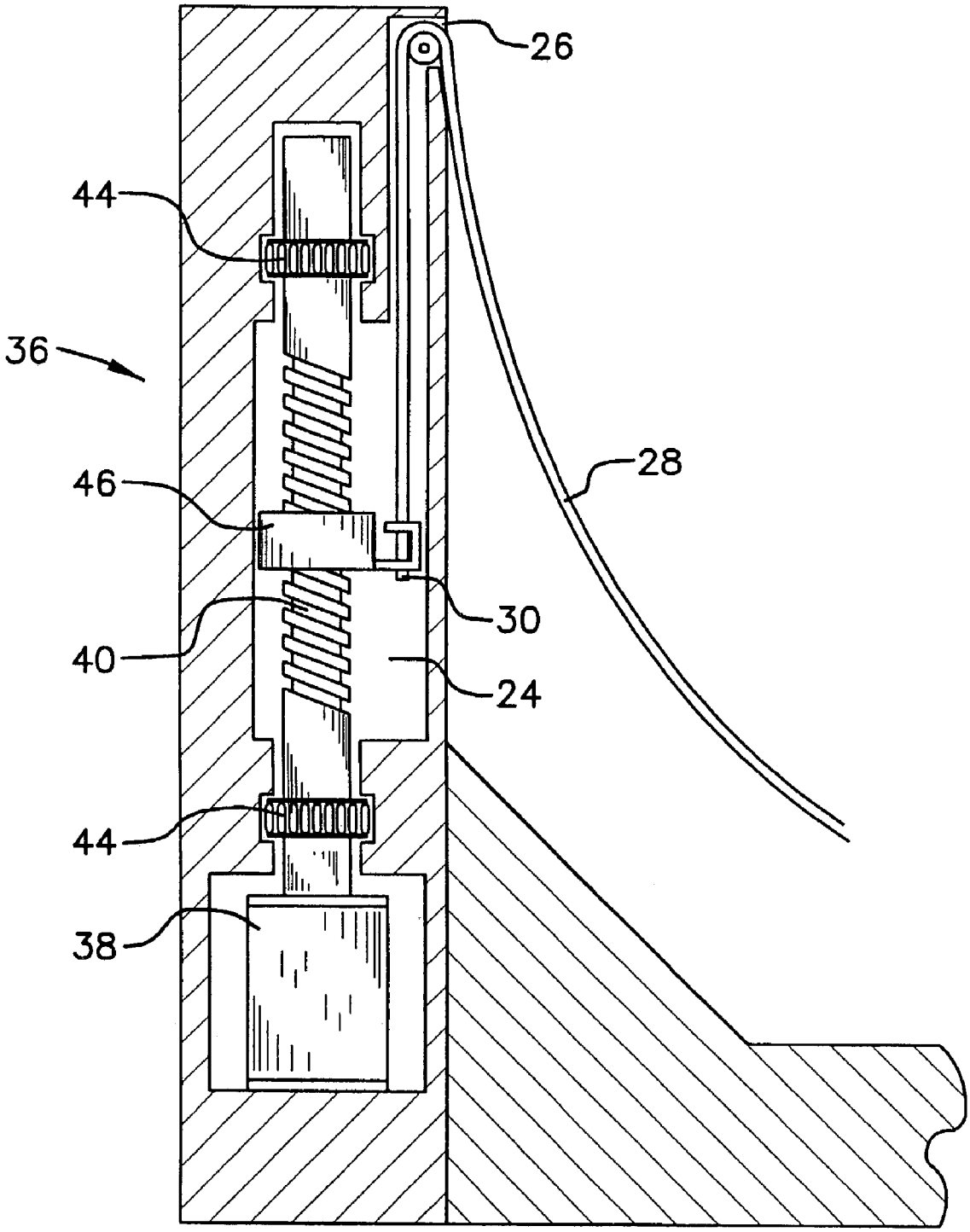
FIG. 3 is a cross-sectional view of taken along the line 3—3 of FIG. 2 of the present invention.
Figure 4:
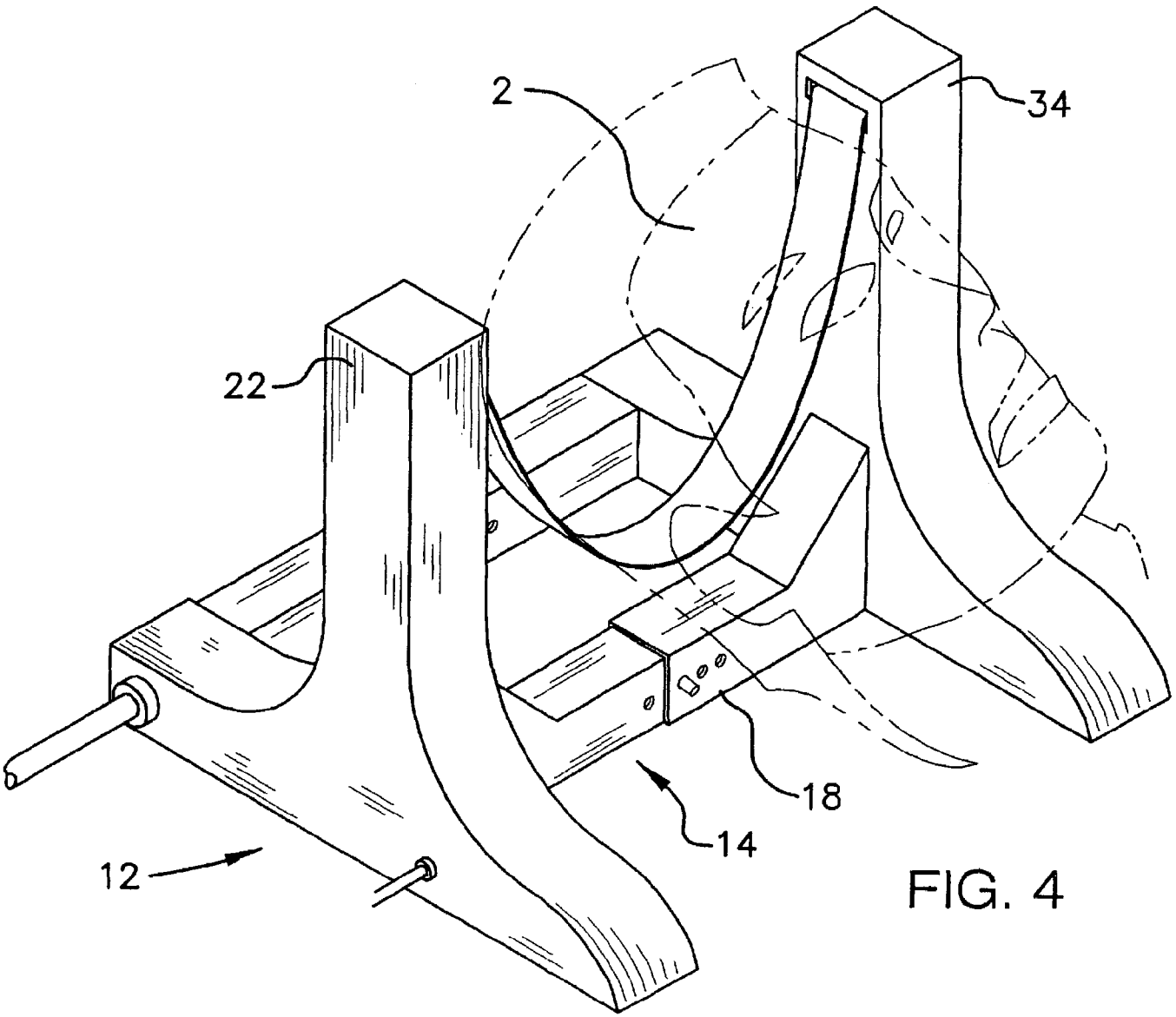
FIG. 4 is a perspective view of the present invention.
Figure 5:
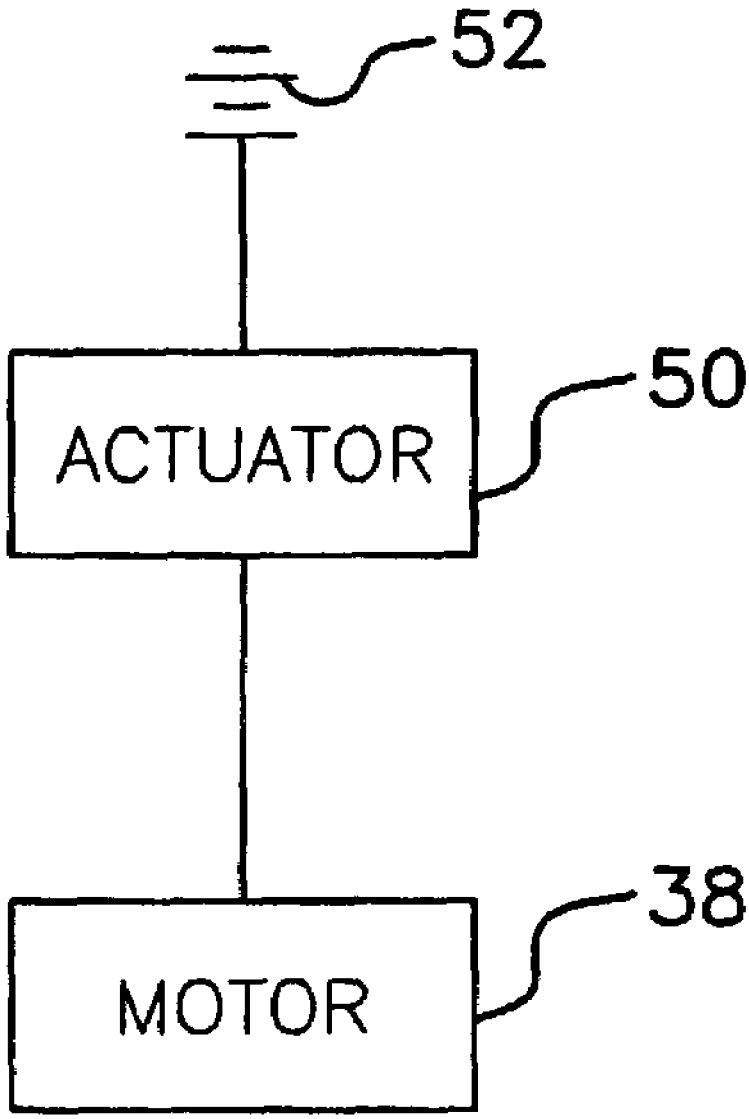
FIG. 5 is a block-diagram view of the present invention.

With reference now to the drawings, and in particular to FIGS. 1 through 5 thereof, a new headrest device embodying the principles and concepts of the present invention and generally designated by the reference numeral 10 will be described.

As best illustrated in FIGS. 1 through 5, the head support device 10 generally comprises a base 12 including a horizontal portion 14 and a pair of vertical members 16 attached to and extending upwardly from the horizontal portion 14. The vertical members 16 are spaced from each other. The horizontal portion 14 includes at least one middle section 18 and a pair of arms 20 attached to opposite ends of the middle section 18 such that the horizontal portion 14 generally has an H-shaped orientation. Additional, a stability bar 19 may be added for additional stability of the device 10. The stability bar extends between and is attached to the arms 20. The stability bar 19 is spaced from and orientated parallel to the middle section 18. The second middle section 19 Each of the vertical members 16 is positioned on one of the arms 20 and each is positioned adjacent to one of the opposite ends of the middle section 18. A first vertical member 22 of the pair of vertical members 16 has a hollow space 24 therein. The first vertical member 22 has an opening 26 therein extending into the hollow space 24. The opening 26 is spaced from the horizontal portion 14. Ideally, the middle section 18 is divided into a first portion 61 and a second portion 62 wherein the first portion is removably extendable into the second portion so that a distance between the arms 20 may be selectively chosen. Preferably, the first 61 and second 62 portions have linearly spaced holes 63 which are alignable with each other and adapted for receiving a pin 64 for securing the first 61 and second 62 portions together. If the stability bar 19 is included, it too will include first and second portions having alignable holes therein for receiving a pin.

A strap 28 has a first end 30 and a second end 32. The first end 30 is extended through the opening 26 and into the hollow space 24. The second end 32 of the strap 28 is attached to a second vertical member 34 of the pair of vertical members 16. The second end 32 of the strap 28 is spaced from the horizontal portion 14.

A retracting mechanism 36 selectively draws the strap 28 into or releases the strap 28 outwardly from the hollow space 24. A portion of the strap 28 positioned between the vertical members 16 is moved upwardly away from the horizontal portion 14 when the strap 28 is drawn into the hollow space 24 and is moved toward the horizontal portion 14 when the strap 28 is released outward of the hollow space 24. The retracting mechanism 36 includes a motor 38 mounted in the hollow space 24. A screw 40 is rotatably coupled to the motor 38 such that the motor 38 may rotate the screw 40 in a first direction or a second direction. The screw 40 is vertically mounted in the hollow space 24 and supported by bearings 44.

A slide collar 46 is threadably mounted on the screw 40. The slide collar 46 moves upward when the screw 40 rotates in a first direction and downward when the screw 40 rotates in a second direction. The slide collar 46 is preferably positioned on rails 48 to stabilize the collar 46 and prevent its rotation. The first end 30 of the strap 28 is attached to the collar 46 such that the strap 28 is drawn into the hollow space 24 when the collar 46 moves downward and the strap 28 is released outward of the hollow space 24 when the collar 46 moves upward.

An actuator 50 selectively turns the retracting mechanism 36 on in a first direction or a second direction. The actuator 50 is operationally coupled to the motor 38. A power supply 52 is operationally coupled to the motor 38.

It is noted that the retracting mechanism 36 is not the only mechanism for drawing the strap 28 inward or out of the first vertical member 22. Other means such a spool may also be used. Also, an alternate embodiment of the device, not shown, may include a pair of retracting mechanisms 36. In such an alternate embodiment, both of the vertical members 16 would have one of the pair of retracting mechanisms therein and the vertical members 16 would be mirror images of each other. If two retracting mechanisms were utilized, the actuator would preferably be adapted for selectively operating the retracting mechanisms one at a time or concurrently.

In use, a user places their head 2 on the strap 28. By using the actuator 50, the strap 28 is moved upward or downward to lift the head 2 in relation to the horizontal portion. By doing so, the neck may be stretched as well as increase blood circulation.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A head supporting device comprises:

a base including a horizontal portion and a pair or vertical members being attached to aid extending upwardly from said horizontal portion, said vertical members being spaced from each other, a first vertical member of said pair of vertical members having a hollow space therein, said first vertical member having in opening therein extending into said hollow space, said horizontal portion including a middle section and a pair of arms attached to opposite ends of said middle section such that said horizontal portion generally has an H-shaped orientation, each of said vertical members being positioned on one of said arms and each being positioned adjacent to one of said opposite ends of said middle section;

a strap having a first end and a second end, said first end being extended through said opening and into said hollow space, said second end of said strap being attached to a second vertical member of said pair of vertical members; and a retracting mechanism for selectively drawing said strap into or releasing said strap outwardly from said hollow space, wherein a portion of said strap positioned between said vertical members is moved upwardly away from said horizontal portion when said strap is drawn into said hollow space and is moved toward said horizontal portion when said strap is released outward of said hollow space.

2. The head supporting device as in claim 1, wherein said retracting mechanism includes a motor being mounted in said hollow space, a screw being rotatably coupled to said motor such that said motor may rotate said screw in a first direction or a second direction said screw being vertically mounted in said hollow space, a slide collar being threadably mounted on said screw, said first end of said strap being attached to said collar such that said strap is drawn into said hollow space when said collar moves downward and said strap is released outward of said hollow space when said collar moves upward.

3. The head supporting device as in claim 2, further including an actuator for selectively turning said retracting mechanism on in a first direction or a second direction, said actuator being operationally coupled to said motor.

4. A head supporting device comprises:

a base including a horizontal portion and a pair of vertical members being attached to and extending upwardly from said horizontal portion, said vertical members being spaced from each other, said horizontal portion including a middle section and a pair of arms attached to opposite ends of said middle section such that said horizontal portion generally has an H-shaped orientation, each of said vertical members being positioned on one of said arms and each being positioned adjacent to one of said opposite ends of said middle section, a first vertical member of said pair of vertical members having a hollow space therein, said first vertical member having an opening therein extending into said hollow space, said opening being spaced from said horizontal portion;

a strap having a first end and a second end, said first end being extended through said opening and into said hollow space, said second end of said strap being attached to a second vertical member of said pair of vertical members, said second end of said strap being spaced from said horizontal portion;

a retracting mechanism for selectively drawing said strap into or releasing said strap outwardly from said hollow space, wherein a portion of said strap positioned between said vertical members is moved upwardly away from said horizontal portion when said strap is drawn into said hollow space and is moved toward said horizontal portion when said strap is released outward of said hollow space, said retracting mechanism including;

a motor being mounted in said hollow space;

a screw being rotatably coupled to said motor such that said motor may rotate said screw in a first direction or a second direction, said screw being vertically mounted in said hollow space;

a slide collar being threadably mounted on said screw, wherein said slide collar moves upward when said screw rotates in a first direction and downward when said screw rotates in a second direction, said first end of said strap being attached to said collar such that said strap is drawn into said hollow space when said collar moves downward and said strap is released outward of said hollow space when said collar moves upward;

an actuator for selectively turning said retracting mechanism on in a first direction or a second direction, said actuator being operationally coupled to said motor; and a power supply being operationally coupled to said motor.

5. A head supporting device comprising:

a base including a horizontal portion and a pair of vertical members being attached to and extending upwardly from said horizontal portion, said vertical members being spaced from each other, a first vertical member of said pair of vertical members having a hollow space therein, said first vertical member having an opening therein extending into said hollow space;

a strip having a first end and a second end, said first end being extended through said opening and into said hollow space, said second end of said strap being attached to a second vertical member of said pair of vertical members; and a retracting mechanism for selectively drawing said strap into or releasing said strap outwardly from said hollow space, wherein a portion of said strap positioned between said vertical members is moved upwardly away from said horizontal portion when said strap is drawn into said hollow space and is moved toward said horizontal portion when said strap is released outward of said hollow space, said retracting mechanism including a motor being mounted in said hollow space, a screw being rotatably coupled to said motor such that said motor may rotate said screw in a first direction or a second direction, said screw being vertically mounted in said hollow space, a slide collar being threadably mounted on said screw, said first end of said strap being attached to said collar such that said strap is drawn into said hollow space when said collar moves downward and said strap is released outward of said hollow space when said collar moves upward.

6. The head supporting device as in claim 5, further including an actuator for selectively turning said retracting mechanism on in a first direction or a second direction, said actuator being operationally coupled to said motor.

* * * * *